US005353522A

United States Patent [19]

Wagner

[11] Patent Number: 5,353,522

[45] Date of Patent: Oct. 11, 1994

[54] SHOE HAVING A REMOVABLE SOLE PORTION

[76] Inventor: Cameron B. Wagner, 6521 Indian Wells Dr., Casper, Wyo. 82604, Germaine Wagner, legal guardian

[21] Appl. No.: 95,561

[22] Filed: Jul. 19, 1993

[51] Int. Cl.[5] ..... A43B 13/00

[52] U.S. Cl. ..... 36/15; 36/103

[58] Field of Search ..... 36/15, 127, 135, 7.2, 36/7.7, 62, 103, 36 R, 41, 42

[56] References Cited

U.S. PATENT DOCUMENTS

| | | | |
|---|---|---|---|
| 256,848 | 4/1882 | Moulton | 36/36 R |
| 788,302 | 4/1905 | Bartley | 36/62 |
| 826,740 | 7/1906 | Perotti | 36/61 X |
| 1,640,301 | 8/1927 | Torchia | 36/15 |
| 2,098,911 | 11/1937 | Brown | 36/78 |
| 2,640,283 | 6/1953 | McCord | 36/62 X |
| 2,776,499 | 1/1957 | Giuntini | 36/135 |
| 3,840,229 | 10/1974 | Phillips | 36/127 X |
| 3,982,336 | 9/1976 | Hero | 36/15 X |
| 4,226,032 | 10/1980 | Herro | 36/61 X |
| 4,261,072 | 4/1981 | Senter | 36/17 PW X |
| 4,807,372 | 2/1989 | McCall | 36/135 |
| 5,065,531 | 11/1991 | Prestridge | 36/15 |

FOREIGN PATENT DOCUMENTS

| | | | |
|---|---|---|---|
| 0215151 | 12/1908 | Fed. Rep. of Germany | 36/15 |

*Primary Examiner*—Paul T. Sewell
*Assistant Examiner*—Ted Kavanaugh
*Attorney, Agent, or Firm*—Rhodes & Ascolillo

[57] ABSTRACT

A shoe, the shoe including an upper and a sole, the sole including at least one fixed sole portion, the fixed sole portion being fixedly attached to the upper, at least one removable sole portion, the removable sole portion being movable between a first position substantially adjacent to the fixed sole portion and a second position substantially separated from the fixed sole portion, the removable sole portion extending across the longitudinal axis of the shoe, and a hinge apparatus for providing a pivotal movement between the shoe and the removable sole portion, whereby the removable sole portion may be moved to the second position to provide access to the interior of the shoe without removal of the shoe from the foot of a wearer.

1 Claim, 2 Drawing Sheets

SHOE HAVING A REMOVABLE SOLE PORTION

BACKGROUND

1. Field of the Invention

The present invention relates to the field of footwear, and most particularly to athletic footwear of the type having a rubber sole (e.g., a "sneaker" or "tennis shoe").

2. Description of the Related Art

U.S. Pat. No. 4,995,173 relates to an article of footwear incorporating a foot actuated pump which is connected to one or more expandable air bladders located in portions of the footwear where contour fitting is desired, and an adjustable relief valve connected to the bladder for releasing air therefrom when a preselected pressure is exceeded.

U.S. Pat. No. 4,009,528 relates to a canvas shoe having an insole that includes a soft pad encased in a sealed film envelope to prevent the absorption of moisture and odors. The envelope includes a chamber disposed without and above the toe portion into which air is expelled by pressure applied by the weight of the wearer.

U.S. Pat. No. 3,556,486 relates to an athletic sneaker having a wedge extending from the heel to just behind the metatarsal heads, an inner heel pad positioned over the wedge, and an outside pad extending three eighths the length of the wedge.

Finally, U.S. Pat. Nos. 319,718 and 273,628 relate to ornamental designs for sneakers.

SUMMARY OF THE INVENTION

In one aspect, the invention generally features a shoe, the shoe including: an upper; and a sole, the sole including: at least one fixed sole portion, the fixed sole portion being fixedly attached to the upper; and at least one removable sole portion, the removable sole portion being movable between a first position substantially adjacent to the fixed sole portion and a second position substantially separated from the fixed sole portion; whereby the removable sole portion may be moved to the second position to provide access to the interior of the shoe without removal of the shoe from the foot of a wearer.

Preferably, the shoe additionally includes a hinge apparatus for providing a pivotal movement between the shoe and the removable sole portion; the shoe has a longitudinal axis, and the removable sole portion extends across the longitudinal axis of the shoe; the at least one fixed sole portion includes at least two fixed sole portions, a fixed forward sole portion and a fixed rear sole portion, and the removable sole portion is disposed intermediate between the fixed forward sole portion and the fixed rear sole portion: the removable sole portion has a major longitudinal axis, and the major longitudinal axis of the removable sole portion extends transversely to the longitudinal axis of the shoe; the hinge apparatus includes an attachment of one side of the removable sole portion to the upper of the shoe; the shoe additionally includes: a first cut extending through the sole of the shoe and positioned between the removable sole portion and the fixed forward sole portion; and a second cut extending through the sole of the shoe and positioned between the removable sole portion and the fixed rear sole portion; the shoe additionally includes an insole, the insole being disposed within the interior of the shoe and overlaying the sole, and each of the first and second cuts extends through the insole; the shoe additionally includes an attachment apparatus for securing the removable sole portion in the first position; and the attachment apparatus includes a buckle apparatus interconnecting the removable sole portion and the upper.

In another aspect, the invention generally features a shoe, the shoe including: an upper; and a sole, the sole including: at least one fixed sole portion, the fixed sole portion being fixedly attached to the upper; at least one removable sole portion, the removable sole portion being movable between a first position substantially adjacent to the fixed sole portion and a second position substantially separated from the fixed sole portion; the removable sole portion extends across the longitudinal axis of the shoe; and hinge apparatus for providing a pivotal movement between the shoe and the removable sole portion; whereby the removable sole portion may be moved to the second position to provide access to the interior of the shoe without removal of the shoe from the foot of a wearer.

Preferably, the shoe additionally includes an attachment apparatus for securing the removable sole portion in the first position; and the attachment apparatus includes a buckle apparatus interconnecting the removable sole portion and the upper.

In a still further aspect, the invention generally features a shoe for wear on a foot of an individual, the shoe being adapted to facilitate the removal of debris from the interior thereof without removal from the foot of the individual, the shoe including: a shoe upper; a fixed shoe sole portion permanently attached to the shoe upper; a removable shoe sole portion; a hinge apparatus pivotally attaching one end the removable shoe portion to the shoe upper, the removable sole portion being rotatable with respect to the shoe upper about the hinge apparatus; and an attachment apparatus for attaching another end of the removable sole portion to the shoe upper.

Preferably, the shoe has a major longitudinal axis, and the removable sole portion is rotatable about an axis that is substantially parallel to the longitudinal axis of the shoe.

One object of the present invention is the provision of a shoe that incorporates an easily accessed and operated mechanism for quickly removing debris (e.g., small stones, etc.) that enter the interior of the article of footwear and cause irritation and discomfort to the wearer thereof.

Another object of the invention is the provision of a shoe that simple in construction and operation and, therefore, inexpensive to manufacture.

The invention will now be described by way of a particularly preferred embodiment, reference being made to the accompanying drawings, wherein:

DESCRIPTION OF THE PREFERRED EMBODIMENT

Figures 1, 2:
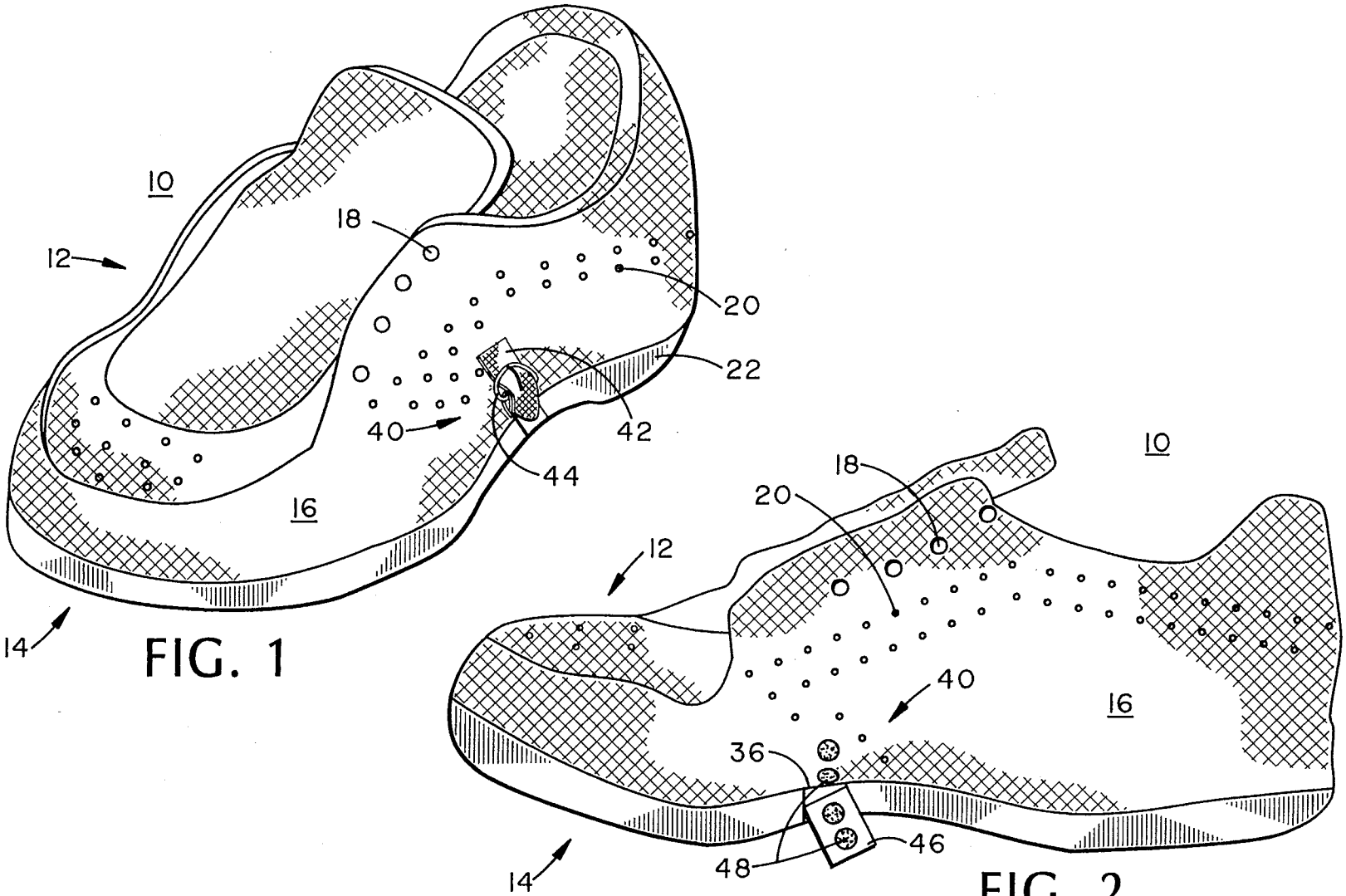
FIG. 1 is a perspective view of a shoe having a removable sole portion constructed according to the present invention.
FIG. 2 is a left side elevational view of an alternative embodiment of the inventive shoe, wherein the inventive shoe is provided with a hook and loop fastener in place of the buckle fastener shown in FIG. 1.

Referring initially to FIG. 1, a shoe 10 constructed according to the present invention generally includes a shoe upper 12 and a shoe sole 14. The shoe upper 12 is of more or less conventional design and includes an upper material 16, for example, canvas, for surrounding and supporting the foot of the wearer, holes 18, for accepting a conventional shoe lace, and, preferably, ventilation holes 20. Additionally, a welt 22 encircles the lower portion of the shoe upper 12, at the point where the shoe upper 12 and the shoe sole 14 are joined. While, for purposes of illustration, only a right shoe 10 is shown in the drawings, it will be understood that there will normally be a matching left shoe that is not shown, but that is preferably also constructed as described herein.

Figures 3, 4, 5:
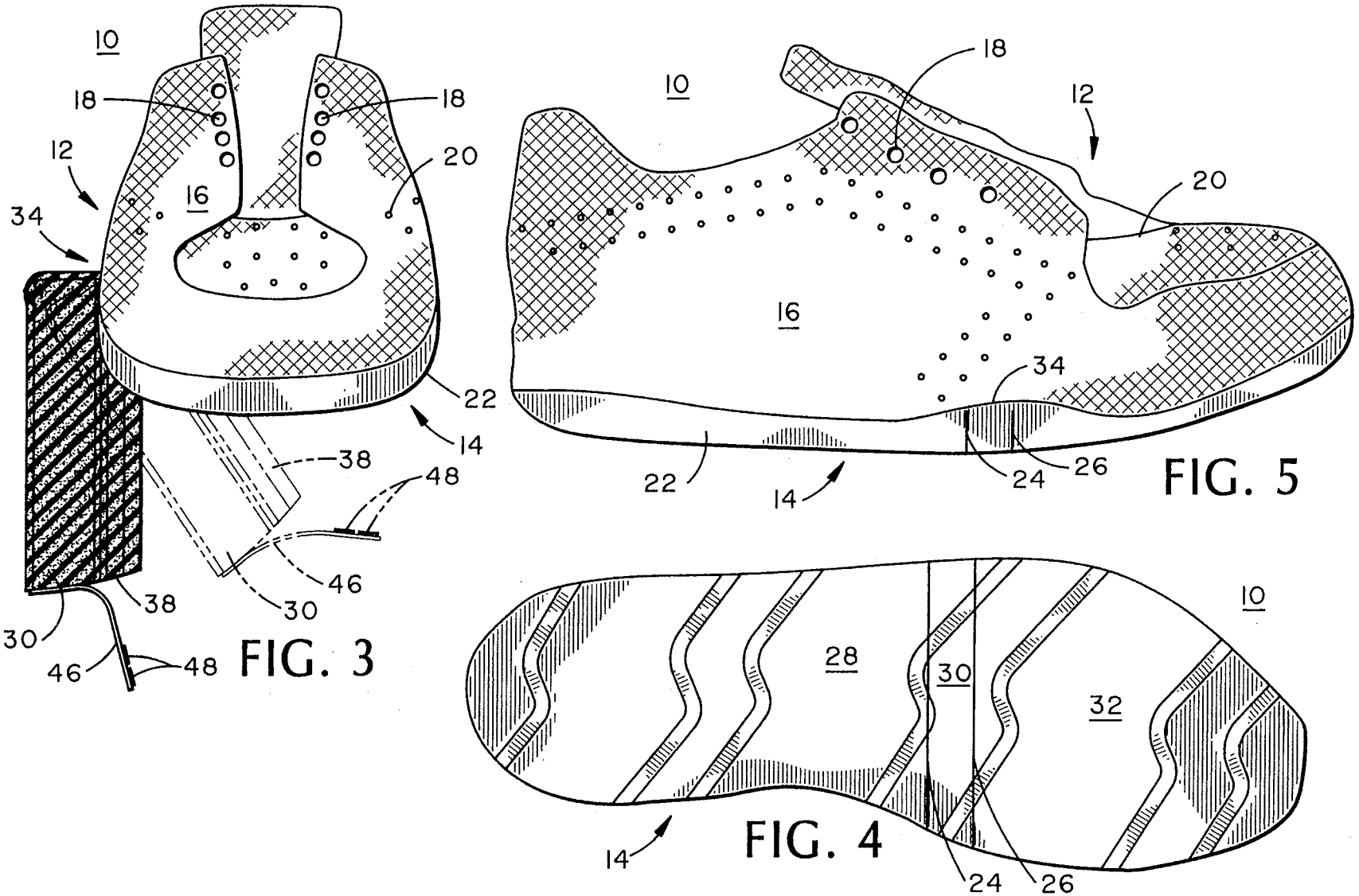
FIG. 3 is a front elevational view of the inventive shoe of FIG. 2, showing the removable sole portion extended away from the remainder of the sole, thereby allowing the removal of debris from the interior of the shoe without requiring the removal of the shoe from the foot of the wearer.
FIG. 4 is a bottom plan view of the inventive shoe.
FIG. 5 is a right side elevational view of the inventive shoe.

As is seen most clearly in FIG. 4, the shoe sole 14 is divided by two cuts, a rearward cut 24 and a forward cut 26, into three distinctive portions: a rear sole portion 28, which extends from the rear of the sole 14 up to the rearward cut 24, located just past the midsole or arch, a removable middle sole portion 30, defined on two sides by the two cuts 24 and 26 and positioned just forward of the midsole or arch, and a forward sole portion 32, which extends from the forward cut 26 up to the front of the sole 14.

The two cuts 24 and 26 pass completely through the sole 14 and extend preferably substantially across the entire width of the bottom face of the sole 14. As seen in FIG. 5, the cuts 24 and 26 extend, on the outer (or right hand) face of the shoe 10, only partially up the welt 22, so as to leave a short pliable section 34 of the welt 22 to act as a hinge. Referring to FIG. 2, it will be seen that a short horizontal cut 36, located just above the welt 22 on the inner (or left hand) face of the shoe 10, extends between the two cuts 24 and 26, thus nearly completely severing the removable middle sole portion 30 from the shoe 10 and leaving it attached thereto only by the hinge 34. The described construction allows the removable middle sole portion 30 to pivot about the hinge 34 and away from the fixed rear and front sole portions 28 and 32, as is shown in FIG. 3. As is also seen in FIG. 3, the cuts 24 and 26 also preferably extend through any insole 38 that may be present within the shoe 10.

Referring back now to FIG. 1, the inventive shoe 10 additionally includes an attachment mechanism 40 for maintaining the removable middle sole portion 30 in the closed position shown in FIGS. 1, 2, 4, and 5. In the preferred embodiment shown in FIG. 1, the attachment mechanism 40 preferably includes a belt 42 attached to the shoe upper 12 and a buckle 44 secured to the removable middle sole portion 30. As shown by the alternative embodiment illustrated in FIGS. 2 and 3, the attachment mechanism 40 may alternatively include a tab 46 attached to and extending from the removable middle sole portion 30 and a pair of hook and loop fasteners 48 secured to the shoe upper 12 and the tab 46. Preferably, the hook and loop fasteners 48 are of, or similar to, the type of hook and loop fasteners commercially available under the trademark "VELCRO".

While the invention has been herein described by way of a particular preferred embodiment, various substitutions of equivalents may be effected without departing from the spirit and scope of the invention as set forth in the following claims.

What is claimed is:

1. A shoe, said shoe comprising:

a rear heel portion;

a forward toe portion;

a first side portion;

a second side portion;

a shoe length extending from said rear heel portion to said forward toe portion;

a shoe width extending from said first side portion to said second side portion;

an upper;

a sole, said sole comprising:

a bottom face;

a welt extending around a periphery of said bottom face and encircling said upper;

at least one fixed sole portion, said welt of said fixed sole portion being fixedly attached to said upper; and at least one removable sole portion, said removable sole portion being movable between a first position substantially adjacent to said fixed sole portion and a second position substantially separated from said fixed sole portion, wherein said removable sole portion extends across said shoe width, said at least one fixed sole portion comprising:

at least two fixed sole portions;

a fixed forward sole portion; and a fixed rear sole portion;

wherein said removable sole portion is disposed intermediate between said fixed forward sole portion and said fixed rear sole portion;

an interior foot chamber formed by said upper and said sole;

means for pivoting said removable sole portion to said second position to provide access to the interior foot chamber of said shoe without removable of said shoe from the foot of a wearer, comprising:

hinge means for providing a pivotal movement between said shoe and said removable sole portion, said hinge means comprising:

an attachment of one side portion of said removable sole portion to said upper of said shoe;

a first cut extending through said sole of said shoe and positioned between said removable sole portion and said fixed forward sole portion;

a second cut extending through said sole of said shoe and positioned between said removable sole portion and said fixed rear sole portion;

an insole, said insole being disposed within said interior foot chamber of said shoe and overlaying said sole, and wherein each of said first and second cuts extends through said insole; and attachment means for releasably securing said removable sole portion in said first position, said attachment means comprising a buckle apparatus interconnecting said removable sole portion and said upper.

* * * * *